US005836044A

United States Patent [19]

Sinnett et al.

[11] Patent Number: 5,836,044

[45] Date of Patent: Nov. 17, 1998

[54] SURFACE CLEANER AND COLLECTOR SYSTEM

[75] Inventors: Chandler G. Sinnett, Falmouth; Marshall Edward Hall, Windham, both of Mass.

[73] Assignee: Chapman Corporation, Portland, Mass.

[21] Appl. No.: 451,529

[22] Filed: May 26, 1995

[51] Int. Cl.[6] ..... B08B 5/02

[52] U.S. Cl. ..... 15/309.1; 15/316.1; 15/409

[58] Field of Search ..... 15/306.1, 309.1, 15/316.1, 409

[56] References Cited

U.S. PATENT DOCUMENTS

| | | | |
|---|---|---|---|
| 2,818,595 | 1/1958 | Rosewall | 15/309.1 |
| 3,222,707 | 12/1965 | Allenbaugh | 15/409 X |
| 3,775,806 | 12/1973 | Olbrant et al. | 15/309.1 |
| 4,454,621 | 6/1984 | Testone | 15/390.1 X |
| 4,670,062 | 6/1987 | Lester | 15/345 X |
| 4,797,528 | 1/1989 | Moore et al. | 15/345 X |
| 5,490,300 | 2/1996 | Horn | 15/309.1 X |
| 5,577,294 | 11/1996 | Polock | 15/409 X |

*Primary Examiner*—Chris K. Moore
*Attorney, Agent, or Firm*—Iandiorio & Teska

[57] ABSTRACT

A surface cleaner and collector system includes: a chamber having an opening for receiving a surface to be cleaned; at least one pressurized air delivery system proximate the surface for establishing an air flow for loosening and entraining contaminants on the surface; a sealing system for sealing the chamber and creating a positive pressure therein; and a collector for trapping the entrained contaminants and passing the air flow.

34 Claims, 14 Drawing Sheets

SURFACE CLEANER AND COLLECTOR SYSTEM

FIELD OF INVENTION

This invention relates to a surface cleaner and collector system and more particularly to such a system which can clean the surface of a web or plate of material. Applicant has filed Disclosure Document No. 343,572 filed Nov. 29, 1993.

BACKGROUND OF INVENTION

In manufacturing their products many industries utilize a web, which is a sheet of material that moves from one roll to another. Generally, the material is paper, plastic, woven fabric, or non-woven fabric; however, a web could be formed of any number of other suitable materials. These industries have found that product quality, plant safety and facility maintenance improve if the webs are cleaned. Web debris can cause a variety of problems, such as: interfering with the web process by leaving defects in the product; accumulating on the web processing equipment and preventing proper operation or producing a fire hazard; and contaminating the sterile environments required in certain applications.

Prior web cleaning systems operate by blowing off, vacuuming, wiping or brushing the debris from the web. Also, other systems have used an ultrasonic whistle and electrostatic repulsion. However, each of these systems has its shortcomings.

Blow-off type systems operate without any provision to collect the debris that is removed from the web. Therefore, the removed debris can cause problems by its presence in the air, or by settling on surfaces in the vicinity of the web.

Vacuum type systems require a vacuum motor nearby the web and/or bulky vacuum hoses or ducts which are utilized to transport the removed debris to a remote collector system. These systems are typically bulky, very loud, require a substantial amount of electrical energy to operate and produce excess heat at the vacuum motor. Moreover, these systems are often ineffective at separating debris from the web due to the difficulty in obtaining a layer of air at the surface that is moving at a speed sufficient to agitate the debris.

Combined vacuum and blow-off systems are somewhat effective at removing and capturing debris, but still suffer from the problems of vacuum motors, hoses, and space for a collector system. Furthermore these systems tend to be relatively expensive.

Wiping and brushing systems require that the web be mechanically contacted and therefore often disturb the web surface. Thus, these types of contact systems are not suitable for all types of web processes.

Ultrasonic whistle systems may provide a more effective blow-off than other types of systems, but they still rely on a vacuum to collect the removed debris. Therefore, these systems have the same shortcomings as the vacuum systems.

Electrostatic repulsion systems are not effective for all types of webs and generally do not remove all types and sizes of particles. In addition, control of the electrostatic repulsion process is generally difficult.

Moreover, while these systems do provide means for cleaning a web surface, albeit rather ineffectively, none of the prior art systems are useful in determining the source of the debris.

SUMMARY OF INVENTION

It is therefore an object of this invention to provide an improved surface cleaner and collector system.

It is a further object of this invention to provide such a surface cleaner and collector system which removes debris from a surface efficiently without contaminating the environment with the removed debris.

It is a further object of this invention to provide such a surface cleaner and collector system cleaning system which removes the debris within a sealed system, thereby preventing escape of the debris from the system.

It is a further object of this invention to provide such a surface cleaner and collector system which removes debris without the need for bulky, loud, and expensive vacuum equipment.

It is a further object of this invention to provide such a surface cleaner and collector system which removes debris without requiring mechanical rubbing or brushing contact with the surface to be cleaned.

It is a further object of this invention to provide such a surface cleaner and collector system which is relatively compact in size and does not release excess heat near the cleaning operation.

It is a further object of this invention to provide such a surface cleaner and collector system which provides a high velocity shearing action of the air at the surface for effectively separating the debris from the surface.

It is a further object of this invention to provide such a surface cleaner and collector system which is capable of showing the pattern of debris on the surface, which is useful as an analytical tool in determining the source of debris.

This invention results from the realization that an improved surface cleaner and collector system can be achieved by providing a sealed chamber having a positive pressure therein and having an opening for receiving a surface to be cleaned, providing at least one pressurized air delivery system proximate the surface for establishing an air flow for loosening and entraining contaminants on the surface, and providing a collector for trapping the entrained contaminants and passing the air flow.

This invention features a surface cleaner and collector system. The system includes a chamber having an opening for receiving a surface to be cleaned. There is a pressurized air delivery system proximate the surface for establishing an air flow for loosening and entraining contaminants on the surface. There is a sealing system for sealing the chamber and creating a positive pressure therein. There is also a collector for trapping the entrained contaminants and passing the air flow.

In a preferred embodiment the surface may be a web or a plate. There may further be included a surface delivery system for transporting the surface through the opening in the chamber. The surface delivery system may include an idler roller, at least a portion of which is positioned within the opening of the chamber, for supporting the surface and introducing it to the chamber. The surface delivery system may include a plurality of air expulsion passages on the surface of the air delivery system and means for introducing an air flow to the surface delivery system and the air expulsion passages to establish a cushion of air between the surface delivery system and the surface to be cleaned. There may further be included a static eliminator system for reducing the static electricity which binds the contaminants to the surface. The static eliminator system may include at least two static eliminator bars positioned on opposite sides of the surface. The air delivery system may include at least one air delivery device positioned proximate the surface. The air delivery device may be positioned 0.002 to 0.500 inches from the surface. The air delivery device may have a length substantially equal to the width of the surface to be cleaned. The at least one air delivery device may include a Coanda air knife. The air delivery system may include two spaced air delivery devices positioned proximate the surface. The air delivery devices may be positioned 0.002 to 0.500 inches from the surface. The air delivery devices may include Coanda air knives. There may further be included a manifold interconnected with one end of the two air delivery devices for supplying air thereto. There may further be included two manifolds, one manifold being interconnected with one end of each air delivery device and the second manifold being interconnected with a second end of each air delivery device. The two air delivery devices may have lengths substantially equal to the width of the surface to be cleaned. The sealing system may include edge seals. The edge seals may include a gap formed by locating the sides of the surface delivery system no greater than approximately 0.200 inches from the edges of the chamber thereby limiting the escape of contaminants. The edge seals may include at least two air delivery devices in close proximity to both ends of the surface delivery system for sealing the edges of the chamber proximate the edges of the surface. The collector may include a filter for trapping the entrained contaminants and passing the air flow. The filter may be located proximate the surface and in a confronting relationship with respect to the surface so that the pattern of contaminants on the surface is depicted on the filter surface. The collector may include a collector vessel which is located remotely from the chamber for collecting the entrained contaminants. There further be included a conduit for interconnecting the chamber and the remote collector vessel. The collector vessel may include a filter for trapping any uncollected entrained contaminants and for passing the air flow. There may further be included means for recirculating the passed air flow from the collector and for introducing a recirculated air flow into the air flow established by the air delivery system. The means for recirculating may include means for filtering the recirculated air flow. The means for recirculating may include collector means for collecting heavier contaminants entrained in the passed air flow. The means for recirculating may include output regulator means for recirculating a portion of the passed air flow to increase the air flow and exhausting the remaining air flow to the atmosphere. There may further be included a filter carrier system for removably positioning the filter proximate the chamber. The filter carrier system may include a removable filter carrier assembly for supporting the filter and a filter carrier assembly receiving means for receiving the filter carrier assembly. The filter carrier assembly may include a plurality of pressure clips which engage a like plurality of pressure clips on the filter carrier receiving means for securing the filter carrier assembly in place. There may further be included means for adjusting the spacing between the air delivery devices and the surface. The means for adjusting may include means for rotatably positioning the air delivery devices proximate the surface, wherein the means for positioning is hinged at one end and moveable at its other end such that the spacing between each said air delivery device and the surface remains substantially equal throughout the adjustment range. The chamber may include a moveable flapper for directing the air flow within the chamber. The collector may include at least two filters and the moveable flapper may be positionable to direct the air flow to either filter or both. There may further be included a second surface cleaning system for cleaning the opposite surface of the surface to be cleaned including: a second chamber having an opening for receiving the opposite surface; at least one pressurized air delivery system in the second chamber proximate the opposite surface for establishing an air flow for loosening and entraining contaminants on the opposite surface; a sealing system for sealing the second chamber and creating a positive pressure therein; and a collector for trapping the entrained contaminants and passing the air flow. The sealing system for the second chamber may include edge seals. The edge seals may include a gap formed by positioning the ends of the surface delivery system in close proximity to the edges of the second chamber thereby limiting the escape of contaminants. The edge seals may include at least two pressurized air delivery devices in close proximity to both edges of the opposite surface for sealing the edges of the second chamber proximate the edges of the opposite surface. The air delivery system may include a source of compressed air for establishing an air flow to the air delivery devices and a regulator device for regulating the air flow to the air delivery devices. The regulator device may include an air amplifier for entraining air to decrease the air supplied from the source of compressed air. There may further be included means for recirculating the passed air flow from the collector. The means for recirculating may include output regulator means for recirculating a portion of the passed air flow, exhausting a portion of the air flow to the atmosphere and entraining a portion of the air flow into the air amplifier. There may further be included an enclosure for enclosing the surface cleaner system. The pressurized air delivery system may include a shaped air delivery device for providing the air flow about the periphery of the chamber. The shaped air delivery device may be circular.

This invention also features a surface cleaner and collector system which includes a chamber having an opening for receiving a surface to be cleaned. There are first and second opposing pressurized air devices proximate the surface for establishing an air flow for loosening and entraining contaminants on the surface. There is a sealing system for sealing the chamber and creating a positive pressure therein. The sealing system includes circular and/or multiple inward-directed pressurized air devices. There is a filter for trapping the entrained contaminants and passing the air flow.

This invention further features a surface cleaner and collector system which includes a chamber having an opening for receiving a surface to be cleaned. There are first and second opposing Coanda air knives proximate the surface for establishing an air flow for loosening and entraining contaminants on the surface. There is a sealing system for sealing the chamber and creating a positive pressure therein. There is also a collector for trapping said entrained contaminants and passing the air flow.

This invention additionally features a surface cleaner and collector system which includes a chamber having an opening for receiving a surface to be cleaned. There are first and second opposing Coanda air knives proximate the surface for establishing an air flow for loosening and entraining contaminants on the surface. There is a sealing system for sealing the chamber and creating a positive pressure therein. The sealing system includes third and fourth opposing Coanda air knives in close proximity to both edges of the surface. There is a collector for trapping the entrained contaminants and passing the air flow.

This invention further features a surface cleaner and collector system. The system includes a chamber having an opening for receiving a surface to be cleaned. There is a shaped air delivery system proximate the surface for establishing an air flow about the periphery of the chamber for loosening and entraining contaminants on the surface. There is a sealing system for sealing the chamber and creating a positive pressure therein and a collector for trapping the entrained contaminants and passing the air flow. In a preferred embodiment the shaped air delivery system is circular.

This invention also features a cleaner and collector system for cleaning opposite surfaces of an object. The system includes a first chamber having an opening for receiving a first surface of the object to be cleaned. There is a first pressurized air delivery system proximate the first surface for establishing an air flow for loosening and entraining contaminants on the first surface. There is a sealing system for sealing the first chamber and creating a positive pressure therein. There is a first collector for trapping the entrained contaminants and passing the air flow. There is further included a second chamber having an opening for receiving a second, opposite surface of the object to be cleaned and a second pressurized air delivery system proximate the second, opposite surface for establishing an air flow for loosening and entraining contaminants on the second, opposite surface. There is a second sealing system for sealing the second chamber and creating a positive pressure therein. There is also a second collector for trapping the entrained contaminants and passing the air flow.

This invention further includes a surface cleaner and collector system which includes a chamber having an opening for receiving a surface to be cleaned and a pressurized air delivery system proximate the surface for establishing an air flow for loosening and entraining contaminants on the surface. There is a sealing system for sealing the chamber and creating a positive pressure therein and a collector vessel located remotely from the chamber for collecting the entrained contaminants and passing the air flow.

This invention further features a surface cleaner and collector system which includes a chamber having an opening for receiving a surface to be cleaned. The system includes a pressurized air delivery system proximate the surface for establishing an air flow for loosening and entraining contaminants on said surface. There is a sealing system for sealing the chamber and creating a positive pressure therein and a collector for trapping the entrained contaminants and passing the air flow. The collector includes at least two filters and a movable flapper which is positionable to direct the air flow to either filter or both.

DISCLOSURE OF PREFERRED EMBODIMENT

Other objects, features and advantages will occur to those skilled in the art from the following description of a preferred embodiment and the accompanying drawings, in which.

Figure 11B:
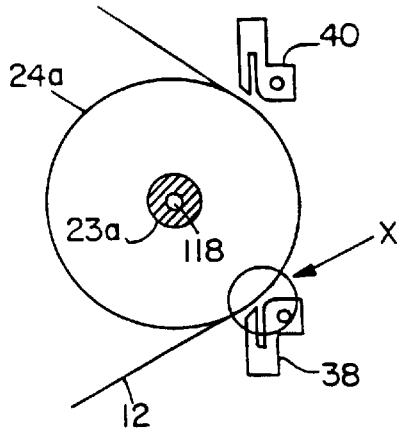
Figure 11A:
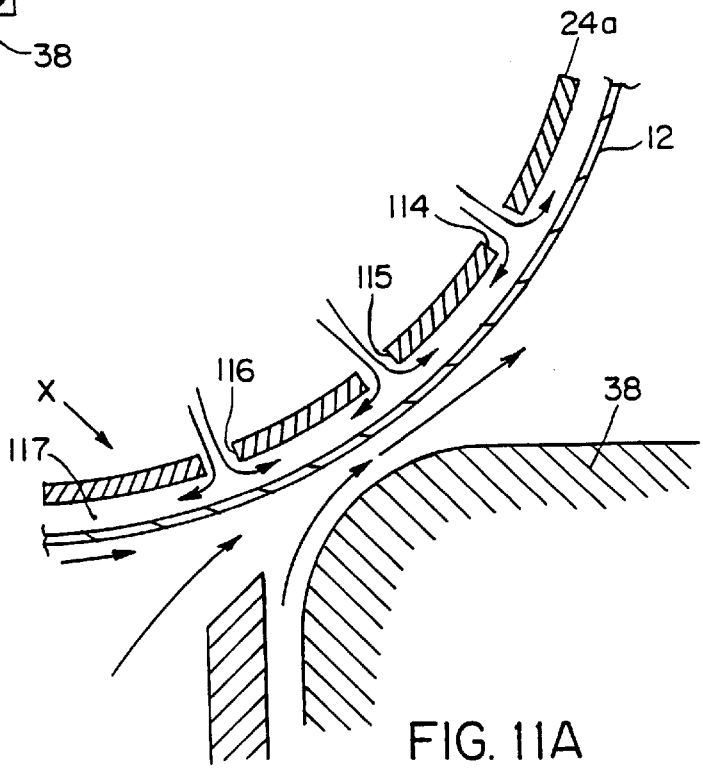
Figure 12A:
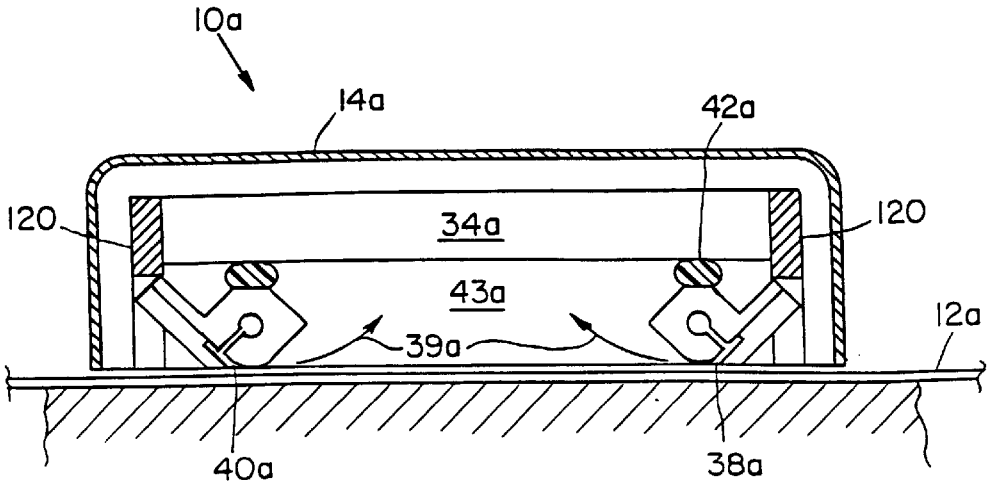
Figure 12B:
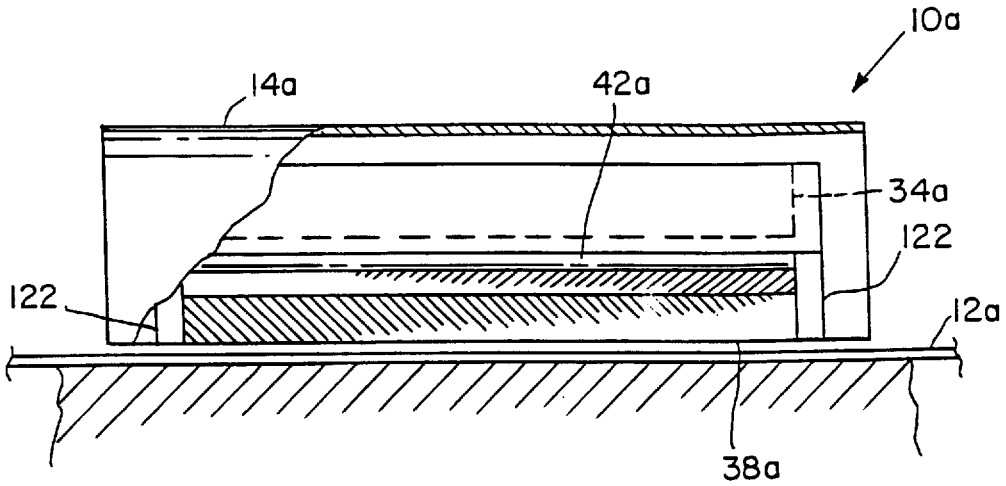
Figure 13A:
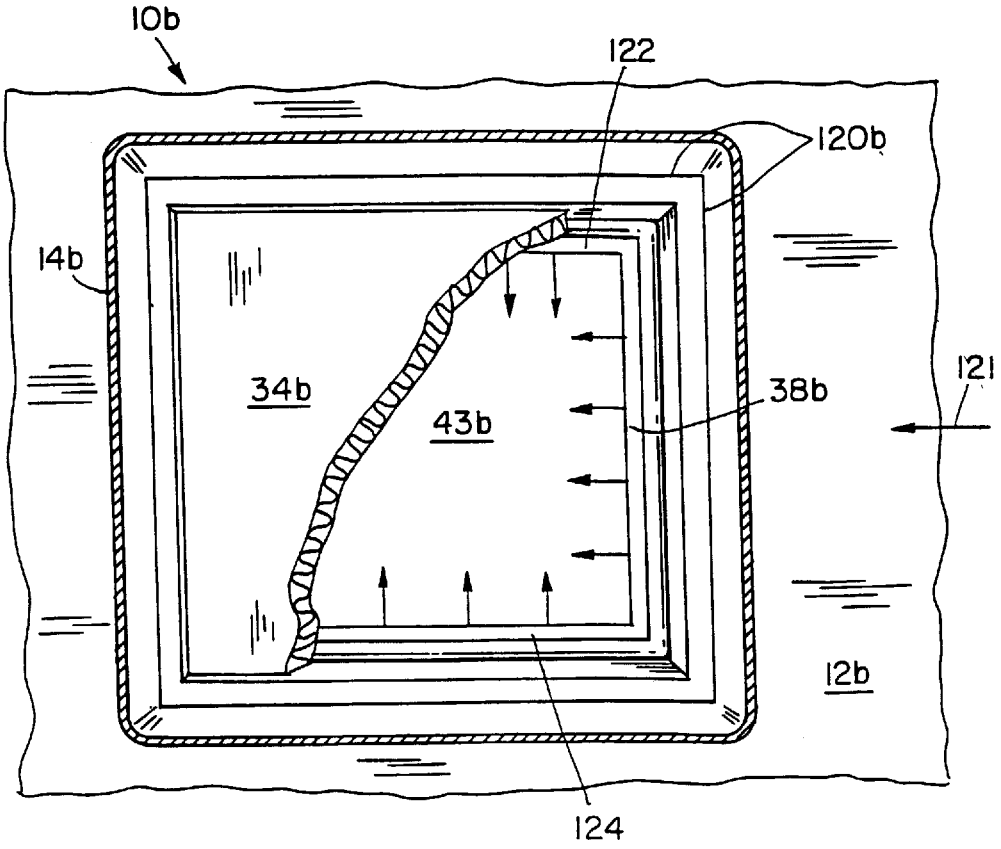
Figure 13B:
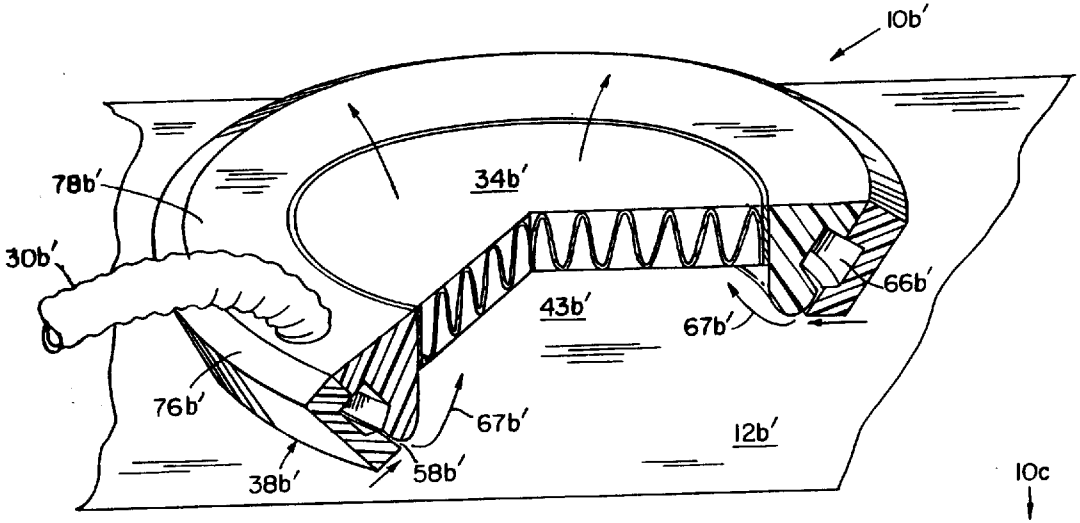
Figure 14:
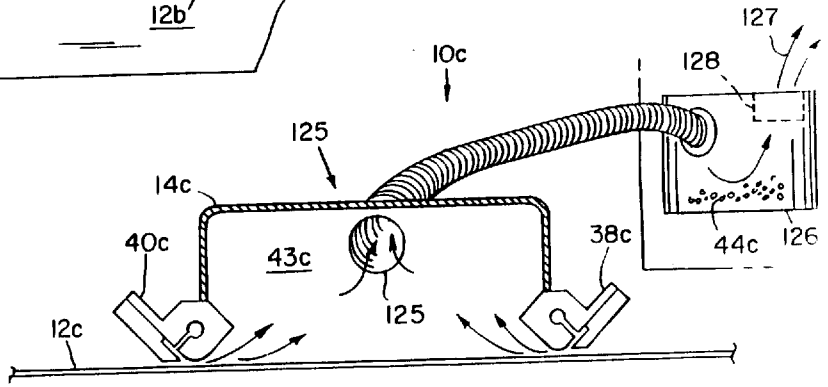
Figure 15:
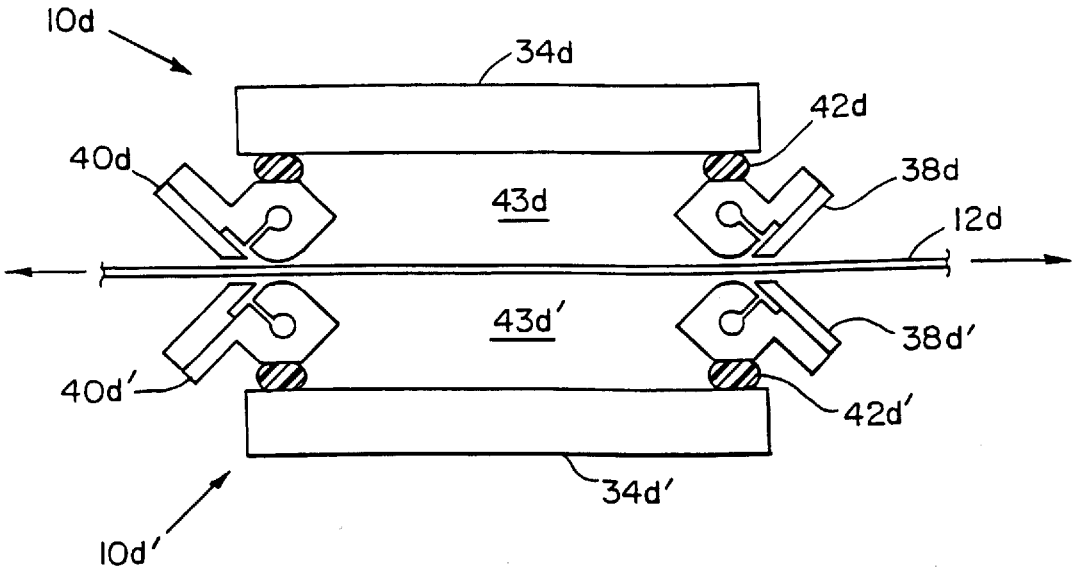
Figure 16:
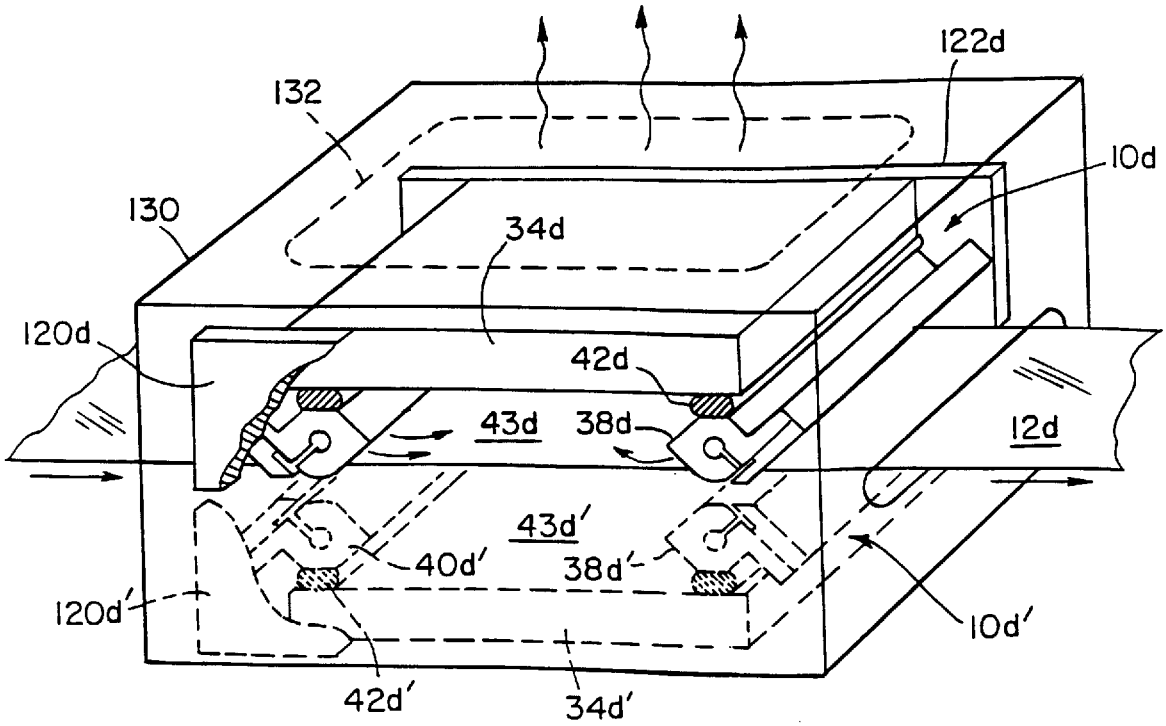
Figure 17:
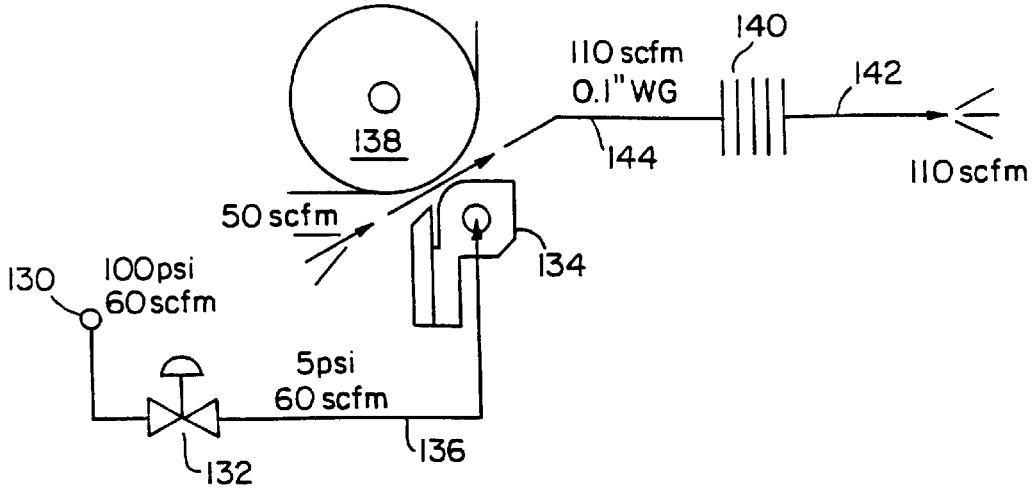
Figure 18:
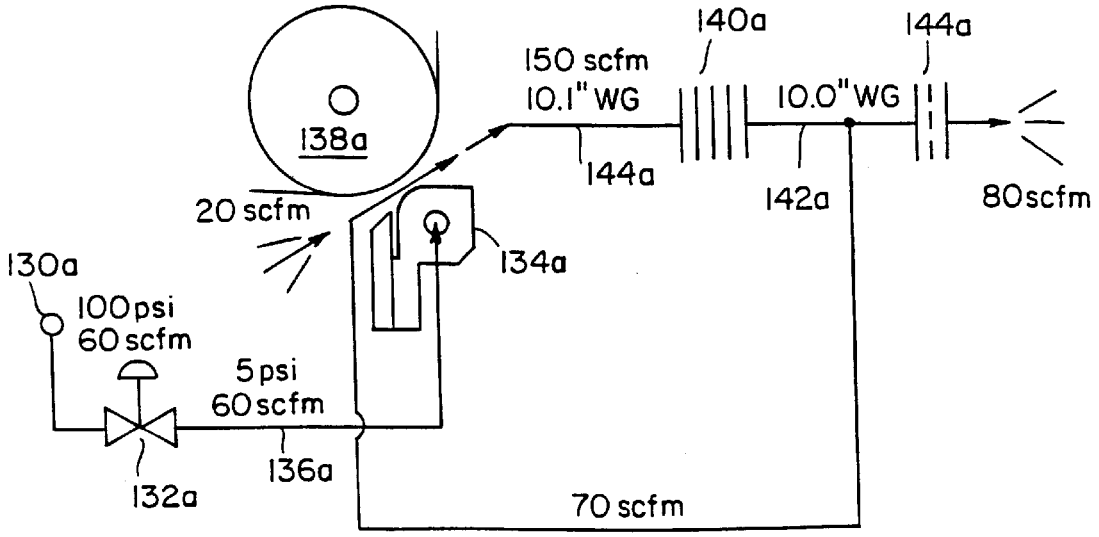
Figure 19:
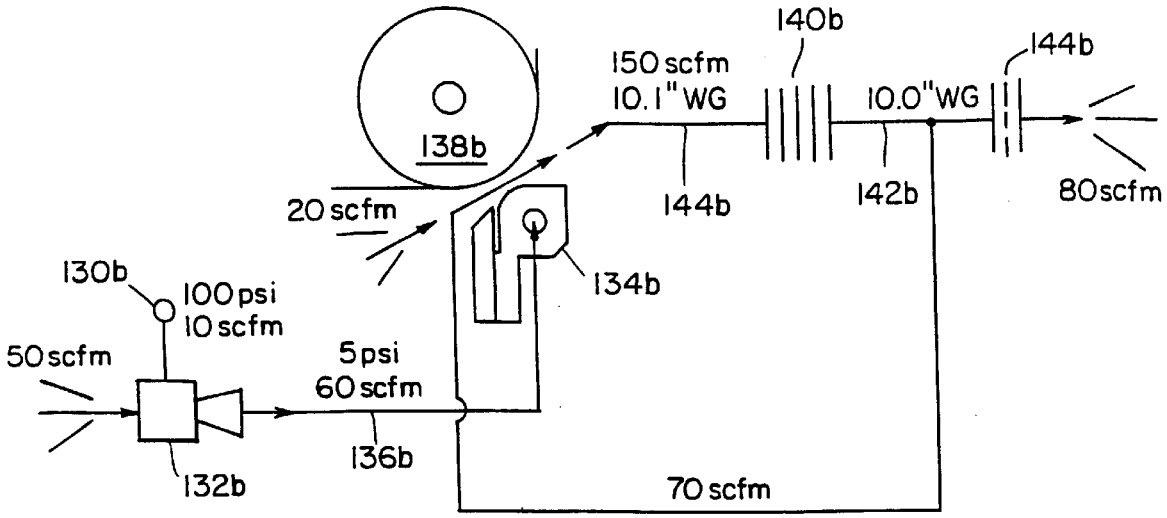
Figure 20:
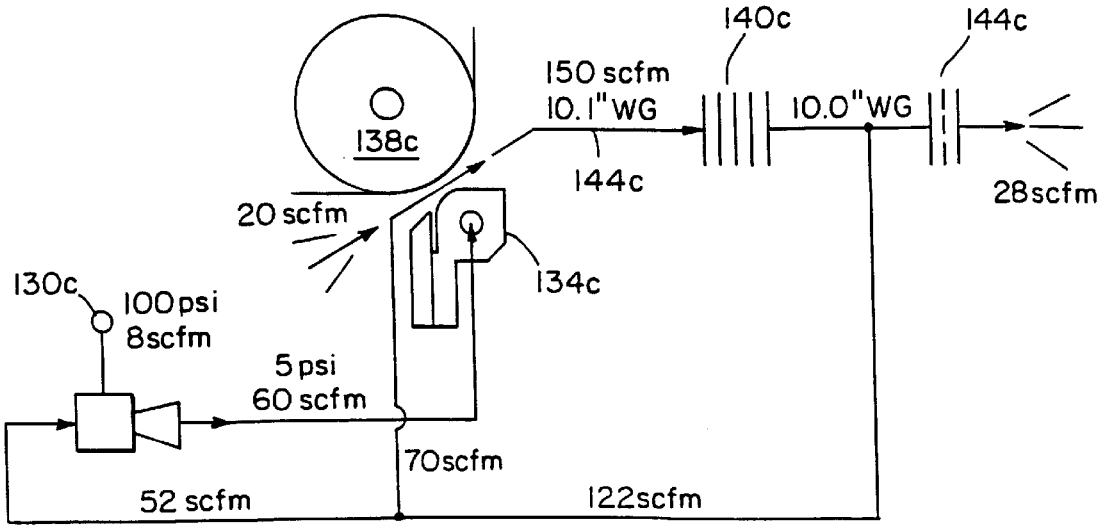

FIG. 11 A is a partial cross-sectional view of an alternative to an idler roller which suspends the surface to be cleaned above a stationary surface by a cushion of air;

FIG. 11B is a partial cross-sectional view of a surface cleaner and collector system according to this invention utilizing the configuration of FIG. 11A;

FIG. 12A is a side cross-sectional view of an alternative embodiment of the surface cleaner and collector system according to this invention for use in cleaning a flat web or surface;

FIG. 12B is a partial cut away view of the surface cleaner and collector system of FIG. 12A;

FIG. 13A is a top partially cut away view of the surface cleaner and collector system of FIG. 12A including two additional air knives positioned proximate the edges of the surface to be cleaned to achieve active edge sealing;

FIG. 13B is a three-dimensional, partially cut away view of an alternative embodiment of the surface cleaner and collector system of FIG. 13A;

FIG. 14 is a schematic view of an alternative embodiment of a surface cleaner and collector system according to this invention which includes a remotely located canister and filter for collecting contaminants;

FIG. 15 is an alternative embodiment of a surface cleaner and collector system according to this invention for simultaneously cleaning opposite surfaces;

FIG. 16 is a three dimensional view of the surface cleaner and collector system of FIG. 12A or FIG. 15 within an enclosure;

FIG. 17 is a schematic view of the basic air supply system of this invention;

FIG. 18 is a schematic view of a recirculated air supply system of this invention with a regulated output;

FIG. 19 is a schematic diagram of the air supply system of this invention utilizing an air amplifier; and FIG. 20 is a schematic diagram of an alternative recirculated air flow system according to this invention.

Figure 1:
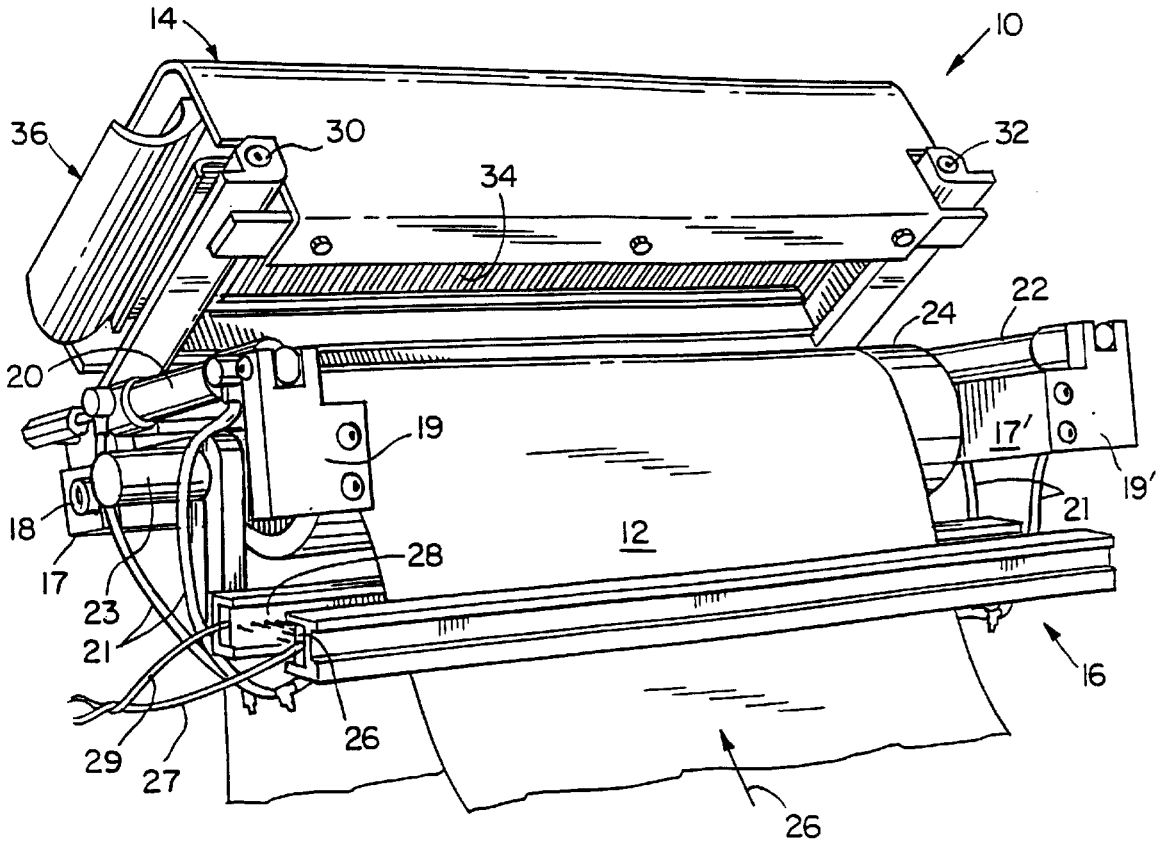
FIG. 1 is a three-dimensional view of a surface cleaner and collector system according to this invention.
Figure 2:
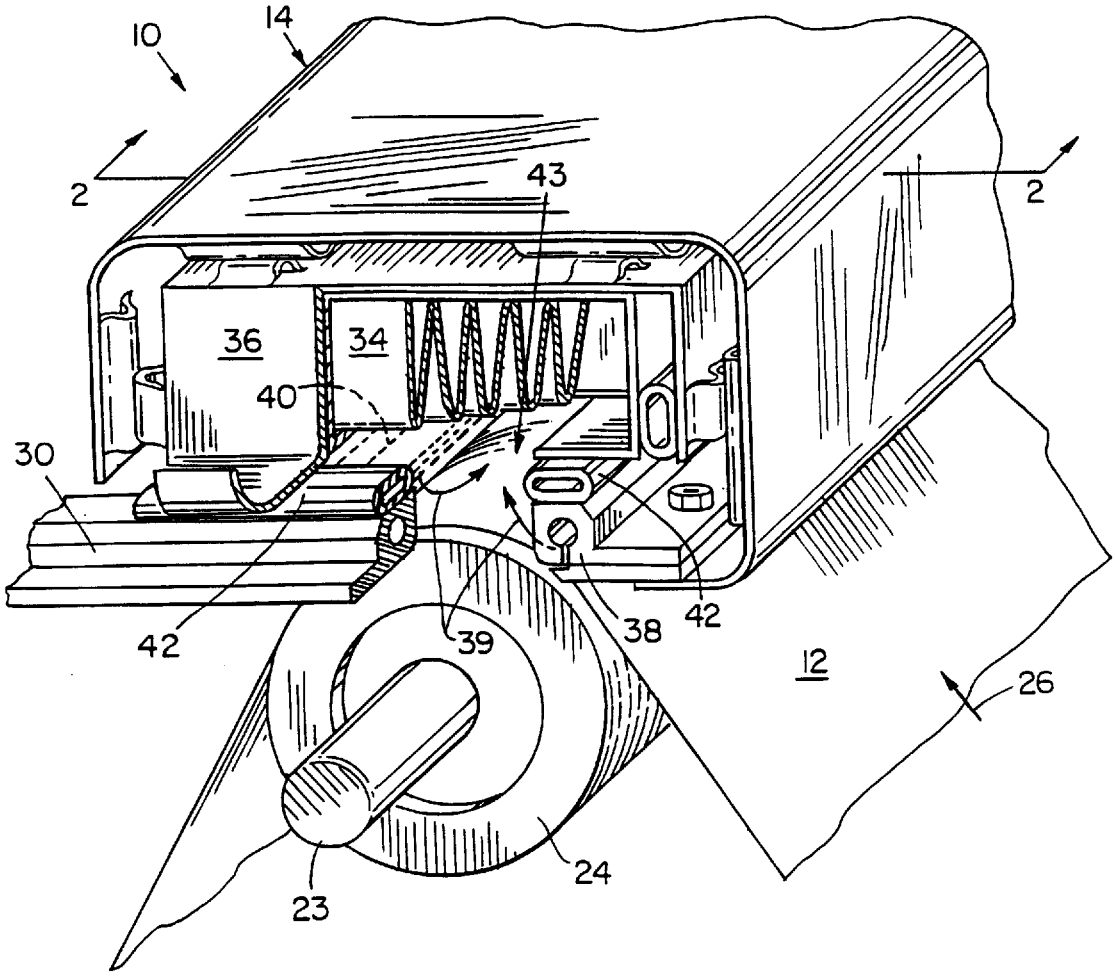
FIG. 2 is a three-dimensional partially cut away view of a portion of the surface cleaner and collector system of FIG. 1.

There is shown in FIG. 1 a surface cleaner and collector system 10 which may be used to clean the surface of web 12. System 10 includes cover housing and base portion generally designated as 14 and 16, respectively. Although not shown, base portion 16 is typically mounted to some sort of support structure. Cover housing 14 is pivotally interconnected with base frame 17 and 17' of base portion 16 and pivots about pivot member 18 and a corresponding pivot member (not shown) at the other end of base portion 16 and cover housing 14. Pistons 20 and 22, which are interconnected at their first ends with cover housing 14 and at their second ends with end walls 19 and 19', control the position of cover housing 14 with respect to base portion 16. As the pistons are extended, cover housing 14 is moved into an open position as shown in FIG. 1, and when the pistons are retracted cover housing 14 is moved into a closed position as shown in FIG. 2. Pistons 20 and 22 are operated under pneumatic control or by air pressure supplied to the pistons by lines 21. In the closed position, cleaning of web surface 12 can be effected as described in detail below by establishing a positive pressure chamber within cover housing 14 and introducing pressurized air to the surface of web 12.

Idler roller support 23 mounted on base frame 17 of base portion 16 rotatably supports idler roller 24 which in turn supports web 12 and enables movement of web 12 through surface cleaner and collector system 10, in this example, in the direction of arrow 26; however, web 12 could be passed through system 10 in either direction. As web 12 is moved into surface cleaner and collector system 10 it passes in close proximity to a pair of static eliminator bars 26 and 28, supplied with a potential over lines 27 and 29, respectively, to create ionized air to remove static electric charge on the web 12 and debris to be removed from the surface of web 12 before it enters system 10.

Figure 6A:
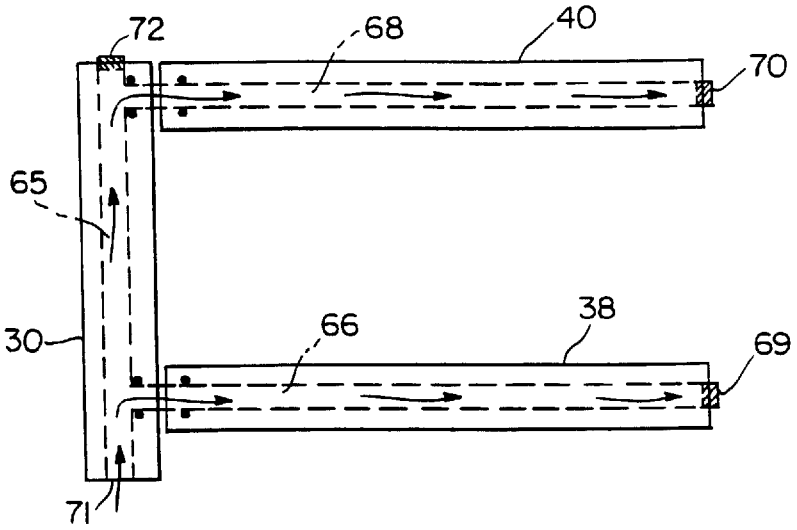
FIG. 6A is a schematic view of one configuration of the air delivery system of this invention.
Figure 6B:
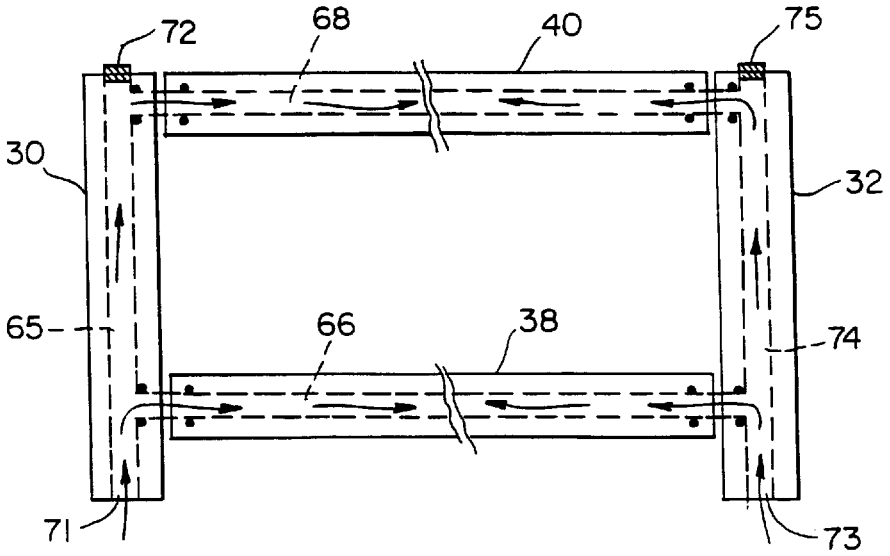
FIG. 6B is an alternative configuration of the air delivery system used in this invention.

Cover housing 14 includes manifolds 30 and 32 which supply an air flow to one or more air sources within cover housing 14 as shown in detail in FIGS. 6A and 6B. Cover housing 14 also includes filter 34 for collecting debris such as contaminants removed from web 12 and filter carrier assembly 36 which enables easy installation and removal of filter 34.

A partial cross-sectional view along both the length and width of cover housing 14 in the closed, cleaning position is shown in FIG. 2. In this position, cover housing 14 is closed and covers a portion of the surface of web 12. Pressurized air sources 38 and 40 (shown in phantom) which supply a pressurized airflow indicated at arrows 39 to the surface of web 12 to remove debris, peripheral seal 42, filter 34 which filters the removed debris and allows the air flow to pass, and the end seals described below with regard to FIGS. 8A and 8B, establish positive pressure chamber 43 (i.e. above atmospheric) which is described in more detail below with regard to FIG. 3. The pressurized air sources are typically located approximately 0.002 to 0.500 inches from the surface. Creating positive pressure chamber 43 enables effective and clean removal of contaminants or particulate matter from the surface of web 12 without the need for powerful and noisy vacuum systems or the need to mechanically contact the surface being cleaned as required in prior art systems.

Figure 3:
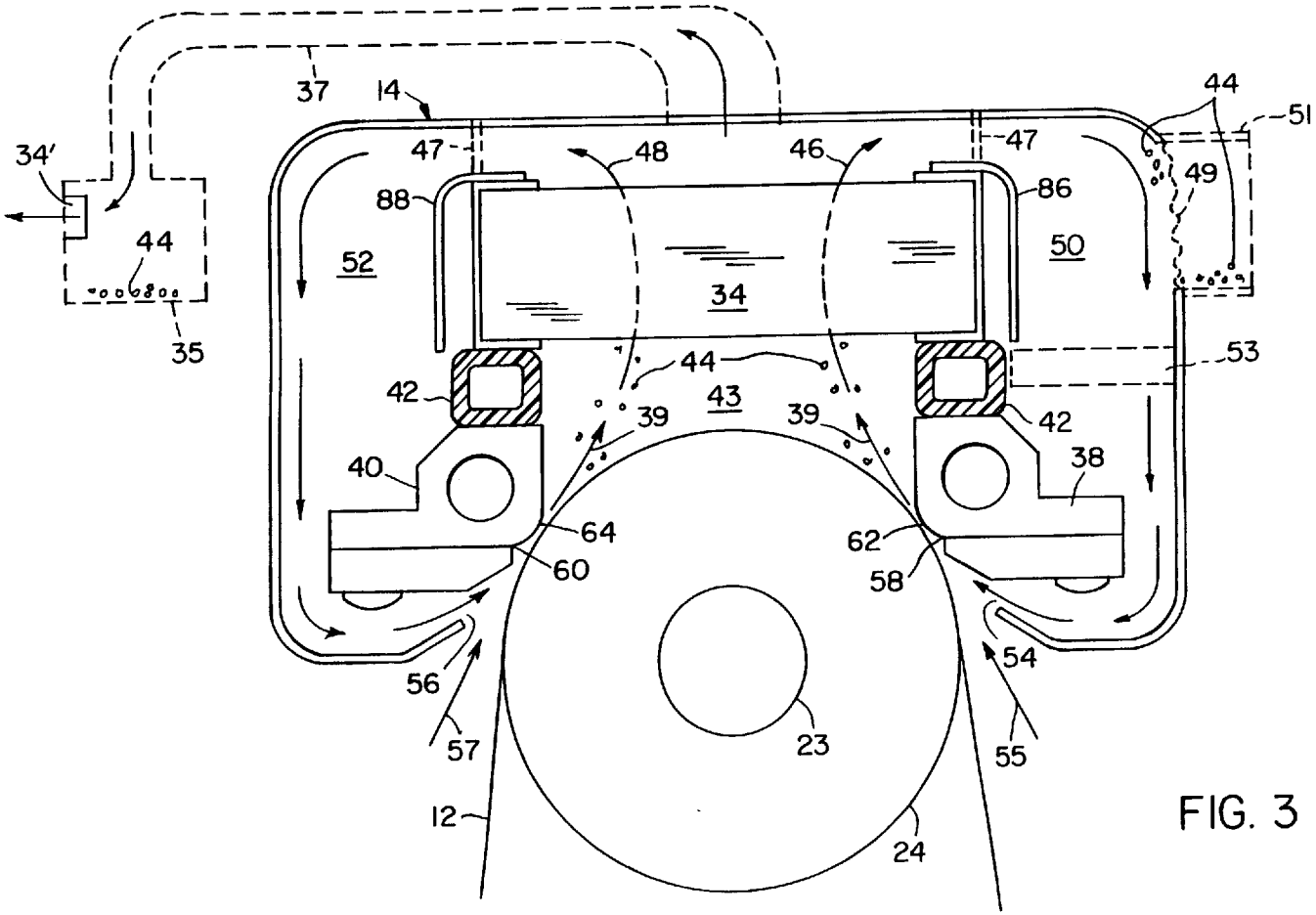
FIG. 3 is a cross-sectional view of the surface cleaner and collector system shown taken along line 2—2 of FIG. 2.

A cross-sectional view of cover housing 14 and idler roller 24 in FIG. 3 illustrates the surface cleaning operation within positive pressure chamber 43. As noted above, positive pressure chamber 43 is created by air sources 38 and 40 in conjunction with peripheral seal 42 and filter 34 which is positioned by filter carrier sides 86 and 88. Idler roller 24 rotates as web 12 moves past air sources 38 and 40, both of which provide a high pressure airflow 39 which impinges on the surface of web 12 and which provides an increased positive pressure in chamber 43. Air flow 39 causes scrubbing of surface 12 and removal and entrainment of contaminants 44 from the surface of web 12. The positive pressure in chamber 43 drives air 39 with entrained contaminants 44 through filter 34 which removes the contaminants and passes the air in the direction of arrows 46 and 48 through air return ducts 50 and 52 to outlets 54 and 56 where it is introduced into the air stream indicated by arrows 55 and 57 and is drawn back into positive pressure chamber 43. Excess air is vented at the ends of ducts 50 and 52 at the open ends of cover 14. As an alternative to recirculating the air flow, ducts 50 and 52 could be eliminated by providing walls 47 shown in phantom which direct the air flow through an opening in cover housing 14. In another alternative configuration, filter 34 may be omitted or replaced by a coarse filter with the addition of a collector 51, shown in phantom, which may be provided to collect contaminants 44 that pass through filter 34 and mesh screen 49. A second filter 53, also shown in phantom, may be provided to further filter the air flow to remove any contaminants not collected by filter 34 or collector 51.

In yet another alternative configuration, filter 34' could be located remotely from cover housing 14 in, for example, canister 35, shown in phantom, which is interconnected with positive pressure chamber 43 by duct 37, also shown in phantom. Duct 37 transports entrained contaminants 44 to canister 35 where they are collected. The air flow from positive pressure chamber 43 passes through filter 34' and out into the atmosphere.

Figure 3A:
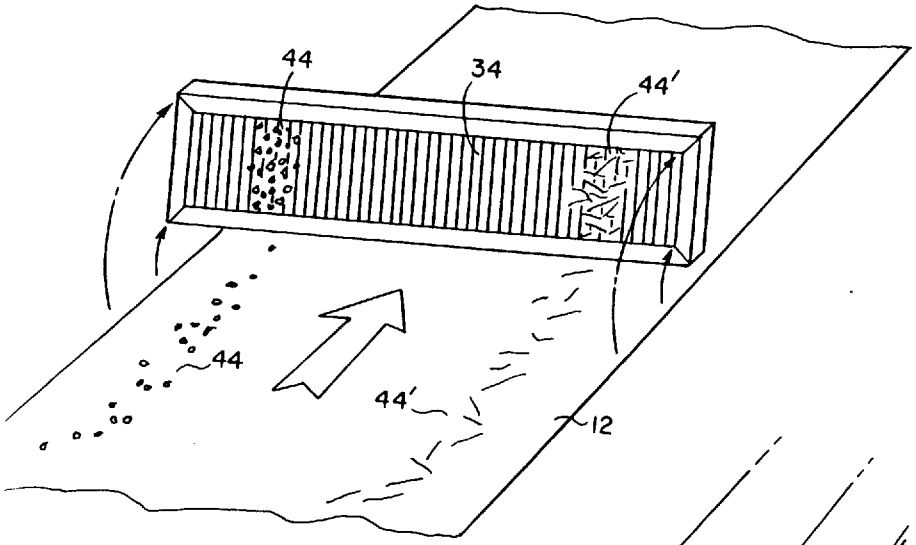
FIG. 3A is a three-dimensional view of the bottom surface of the filter and surface shown in FIGS. 2 and 3.

As shown in FIG. 3A the bottom surface of filter 34 which receives the incoming air flow with entrained contaminants typically will include distinct areas of contaminants 44 (type A) and 44', which may be a different type of contaminant (type B), in positions which correspond to the location of the contaminants on the surface of web 12. It is possible to observe the pattern of contaminants on the surface of filter 34 and use this pattern as an analytical tool in determining the source of contaminants on web 12, as the contaminants do not diverge much from web 12 to the surface of filter 34. In this figure filter 34 is shown rotated to illustrate collection of contaminants and surface 12, although shown in FIGS. 1 and 2 being transported around idler roller 24, is shown in a flat configuration for illustration purposes.

Figure 4B:
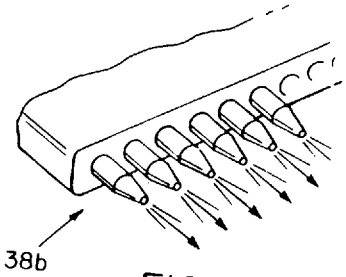
FIG. 4B is a three-dimensional view of another alternative air delivery device.
Figure 4A:
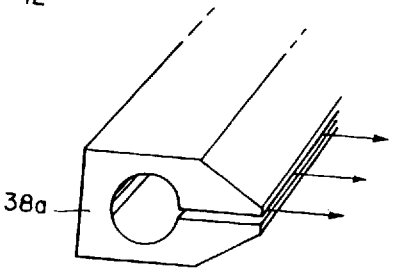
FIG. 4A is a three-dimensional view of an alternative air delivery device.

Although in the particular embodiment shown in FIGS. 2 and 3, two air sources 38 and 40 are used, in fact, only one could be a pressurized air source; the other one could be a conventional sealing device. Further, in this figure both air sources 38 and 40 are Coanda type air knives which cause the air coming out of narrow slits 58 and 60 to follow the curvature of surfaces 62 and 64 of air sources 38 and 40. The construction of air sources 38 and 40 is described in more detail below with regard to FIG. 5. Although Coanda air knives are the preferred type of air source, conventional air knives such as 38*a* shown in FIG. 4A, or even a series of nozzles such as 38*b* shown in FIG. 4B, can be used.

Figure 5:
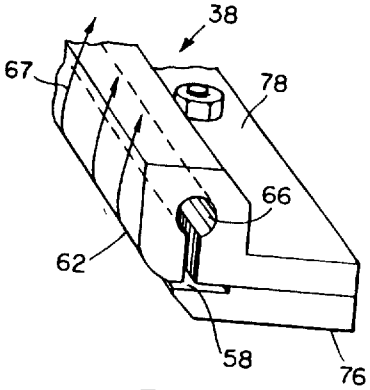
FIG. 5 is a three-dimensional view of a Coanda air knife.

The preferred Coanda type air knife 38, FIG. 5, includes a channel 66 which receives pressurized air from manifold 30 or 32, FIG. 1, or both, as shown in FIGS. 6A and 6B. In FIG. 6A, channel 66 of air knife 38 and channel 68 of air knife 40 are interconnected with channel 65 of manifold 30 at one of their ends which supplies channels 66 and 68 with pressurized air. At the other ends of channels 66 and 68 are plugs 69 and 70. Manifold 30 receives pressurized air at inlet 71 of channel 65 and includes a plug 72 at the opposite end on channel 65. In FIG. 6B channels 66 and 68 of air knives 38 and 40 are connected at their first end with manifold 30 which supplies the channels with pressurized air and at their second ends with manifold 32 which also supplies channels 66 and 68 with pressurized air introduced into inlet 73 of channel 74. The other end of channel 32 of manifold 74 is sealed by plug 75. Referring again to FIG. 5, channel 66 terminates in exit slot 58 defined by an area formed by machining or the use of a shim between cover portion 76 and base portion 78 of air knife 38. Slot 58 forces the air out in the direction of arrows 67 so that it impinges upon on the surface of web 12 (not shown in this figure). Because surface 62 of base portion 78 extends beyond the termination of cover portion 76, atmospheric pressure which is higher than the pressure of the air flow, causes a positive pressure in the direction of surface 62 causing the air flow 67 to follow the contour of surface 62. This effect is often referred to as the Coanda effect and air knives which operate in this manner are generally referred to as Coanda air knives.

Figure 7A:
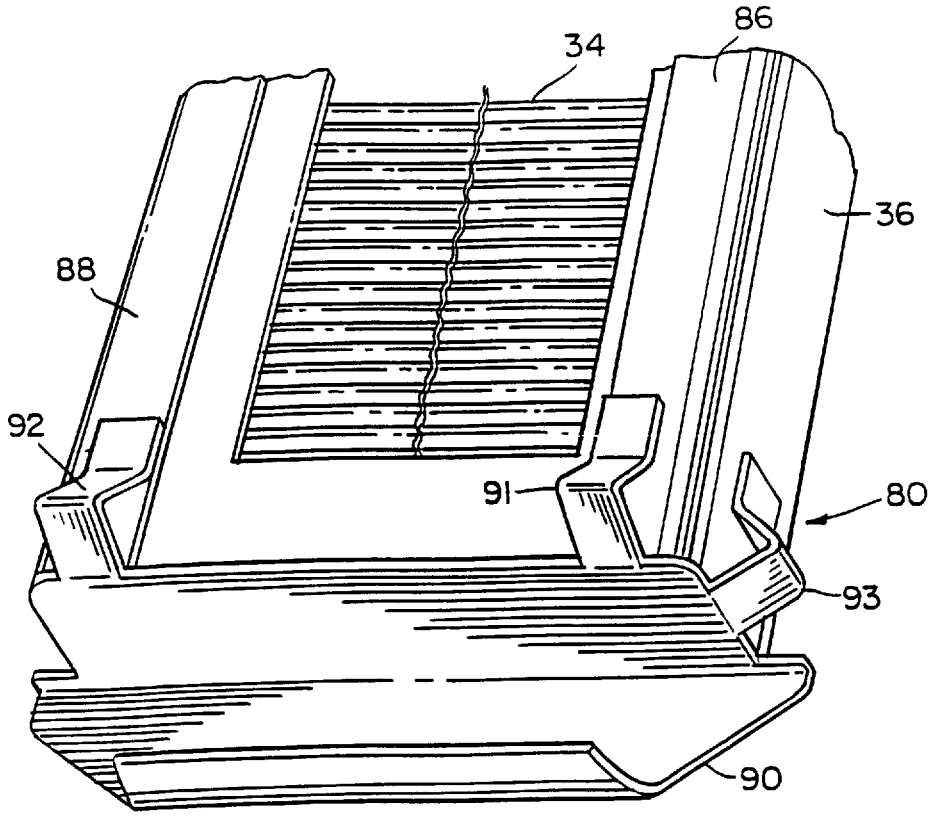
FIG. 7A is a partial three-dimensional view of the filter and filter carrier assembly according to this invention.
Figure 7B:
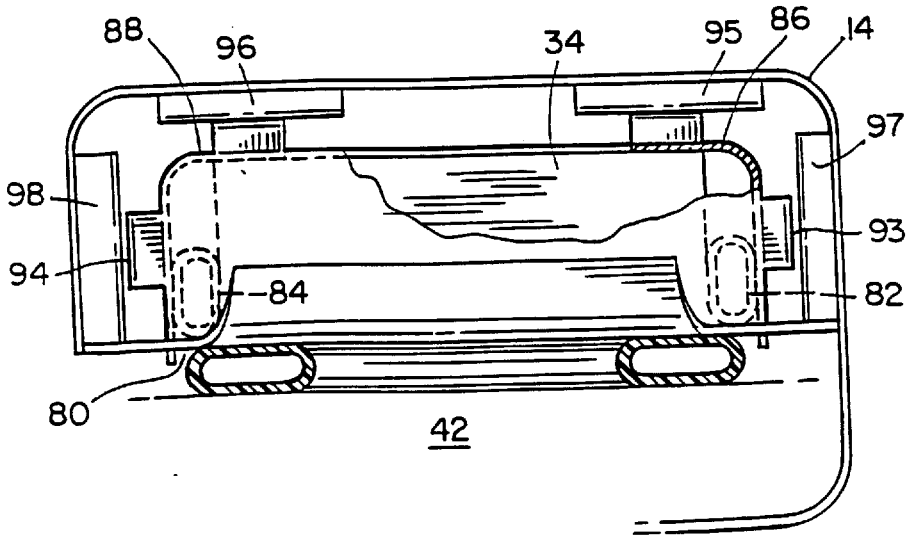
FIG. 7B is an end view of the cover housing, filter and filter carrier assembly according to this invention.

Filter 34 and filter carrier assembly 36 are partially shown in more detail in FIGS. 7A and 7B. Filter 34, FIGS. 7A and 7B, is installed through an opening 80 in the underside of filter carrier assembly 36 and is retained therein by means of frictional contact with seals 82 and 84 and upper surfaces 86 and 88 of filter carrier assembly 36. Filter carrier assembly 36 includes handle 90 which enables easy installation and removal of it from cover housing 14. Filter carrier assembly 36 includes top pressure clips 91 and 92 at its first end and two other pressure clips (not shown) at its other end. It also includes four side pressure clips, only two of which, clips 93 and 94, are shown in these figures. These clips engage complementary clips 95–98 within cover housing 14 located near its first end to secure the assembly in place. There are also four other complementary clips within cover housing 14, (not shown) located near its other end which engage the four pressure clips on filter carrier assembly 36 which are also not shown. Assembly 36 is seated upon peripheral seal 42.

Figure 8A:
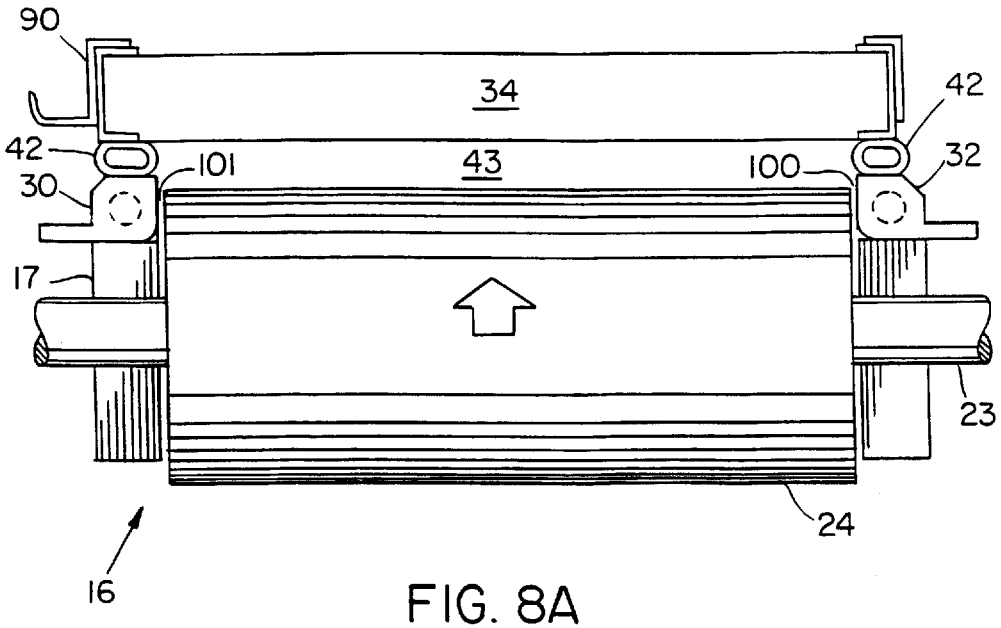
FIG. 8A is a front cross-sectional view of the surface cleaner and collector system of FIG. 2 depicting the end seals.
Figure 8B:
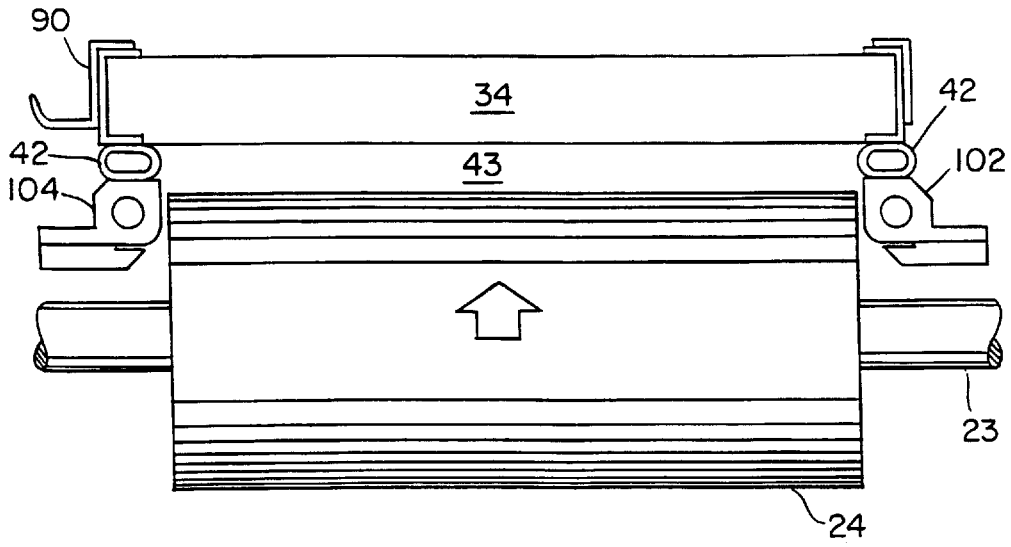
FIG. 8B is a front cross-sectional view of the surface cleaner and collector system of FIG. 2 depicting active end seals.

FIG. 8A depicts the air seals formed at the ends of idler roller 24 by close gaps 100 and 101 which are approximately 0.005 in. to 0.100 in. The close gaps restrict the air escape from chamber 43 to minimize the unwanted release of contaminants 44. When filter 34 provides little back-pressure to chamber 43, and when there is adequate air flow through the filter 34, the close gaps 100 and 101 can allow entrainment of air moving into chamber 43, thus providing an effective seal. Alternatively, the end seals may be actively achieved by providing additional air sources, such as air knives 102 and 104, FIG. 8B, at the ends of idler roller 24 to provide an additional air flow into and seal the ends of chamber 43. Air knives 102 and 104 also serve as manifolds to supply air to air sources 30 and 32. Also alternatively, the end seals to the idler roll may be accomplished by any of the mechanical seal systems known to those skilled in the art.

Figure 9:
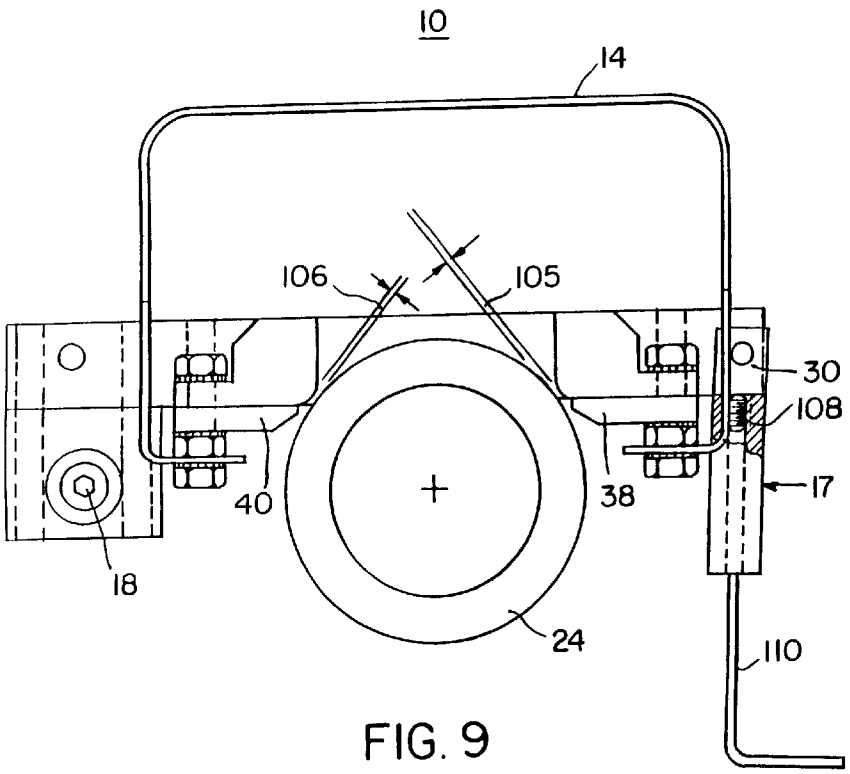
FIG. 9 is a cross-sectional view of the surface cleaner and collector system taken along line 2—2 of FIG. 2 depicting the gap adjustment means.

Surface cleaner and collector system 10, as shown in FIG. 9, allows for the adjustment of gaps 105, 106 between the surface of web 12 and air sources 38 and 40. This is accomplished by adjusting set screws 108 (within end walls 19 and 19') which contact manifolds 30 and 32 of cover housing 14 by using hex wrench 110. Adjusting set screws 108 moves the closed position of cover housing 14 more open or closed by contacting manifolds 30 and 32. Cover housing 14 pivots about pivot point 18, but because of the selected geometry, when one end of the cover housing 14 is raised and the other end swings about pivot 18 both gaps 105 and 106 remain essentially equal in size throughout the adjustment range.

Figure 10:
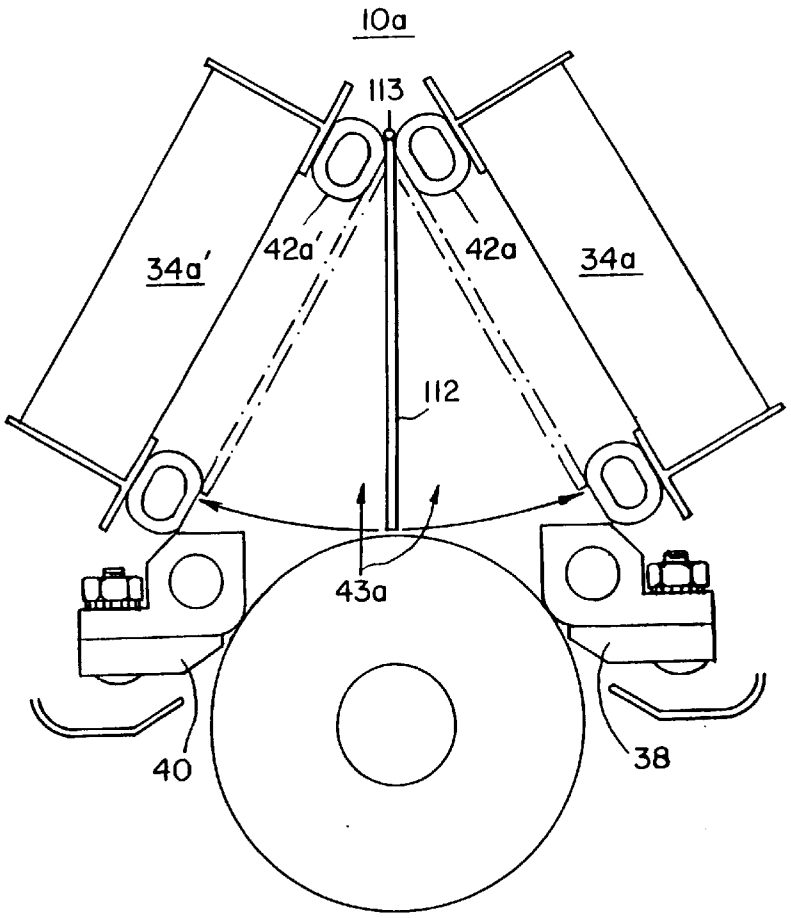
FIG. 10 is a cross-sectional view of an alternative two-filter configuration according to this invention.

In an alternative embodiment, surface cleaner and collector system 10*a*, FIG. 10, can be equipped with two filters 34*a* and 34*a*' which are set upon peripheral seals 42*a* and 42*a*'. There is a divider member 112 which pivots about point 113 to divide positive pressure chamber 43*a* into two sections and to divide the air flow between the two filters 34*a* and 34*a*'. Also, divider member 112 may be moved into contact with either peripheral seal 42*a* or 42*a*' to prevent the air flow through either filter 34*a* or 34*a*' so that the filters may be changed without interrupting the surface cleaning process.

An alternative to the idler roller is a stationary surface 24*a*, FIGS. 11A and 11B, which includes a plurality of air vents 114–116 on its surface for creating an air cushion in gap 117 formed between surface 24*a* and web 12 for floating web 12 above the surface 24*a*. This type of surface can be used in those applications which require that the web not contact the idler roller. As shown in FIG. 11B, air flotation bar 23*a*, which supports stationary surface 24*a*, includes a port 118 for interconnecting with a pressurized air source to provide vents 114–116 with a pressurized air flow. In this configuration, end seals 100 and 101 can be made by contact, since there is no relative motion of the surfaces.

An alternative embodiment of this invention is shown in FIGS. 12A and 12B where surface cleaner and collector system 10*a* is configured to clean a flat surface such as web or plate 12*a*. This system is configured similarly to surface cleaner and collector system 10, FIG. 1, as it includes a cover housing 14*a* which includes therein sealed positive pressure chamber 43*a* established by air sources 38*a*, 40*a*, filter 34*a* and peripheral seal 42*a*. Pressurized air indicated at arrows 39*a* impinges upon the surface of web or plate 12*a* to remove and entrain contaminants and carry them into filter 34*a* where they are retained as the air flow passes through the filter. Side walls 120 and 122 support filter 34*a*, air sources 38*a* and 40*a* and provide seals to the surface.

Another alternative embodiment of this invention, surface cleaner and collector system 10*b*, is shown in FIG. 13A. In this embodiment, there are included two air sources 38*b*, 40*b* (not shown) which provide an air flow parallel to the direction of web movement indicated by arrow 121 and two other air sources 122 and 124 which provide an air flow perpendicular to the direction of web movement. These two additional air sources provide additional sealing of positive pressure chamber 43*b* as well as additional scrubbing of web 12*b* and entrainment of contaminants and the combination of air sources form a peripheral boundary of air flow directed toward chamber 43*b* and surface 126. It will be apparent to those skilled in the art that the same effect can be accomplished by the use of a number of air sources arranged to provide the same effect.

Surface cleaner and collector system 10*b*', FIG. 13B, is an alternative embodiment to the surface cleaner and collector system 10*b*, FIG. 13A. Air source 38*b*' is circularly shaped such that it provides a peripheral boundary of air flow directed toward surface 12*b*' and chamber 43*b*'. Shaped air source 38*b*' could be formed in one continuous piece or it could be formed of several component pieces. Moreover, air source 38*b*' need not be circular and it may be formed of various shapes which will apparent to those skilled in the art. Air source 38*b*' is a Coanda type air knife which is composed of a cover portion 76*b*' and a base portion 78*b*' with channel 66*b*' formed therein terminating in exit slot 58*b*'. Compressed air is supplied to channel 66*b*' by means of air supply 30*b*'. Air exiting exit slot 58*b*' is shown at arrow 67*b*' to impinge upon the surface 12*b*', travel through chamber 43*b*' and circular filter 34*b*'. Although the air source 38*b*' in this figure is shown to be of the Coanda type any of the alternative configuration, such as those shown in FIGS. 4A and 4B can be used.

Placing a filter proximate the web surface to be cleaned is not a necessary limitation of this invention. As shown in FIG. 14 surface cleaner and collector system 10*c* does not utilize a filter within cover housing 14*c*, but rather there is included exhaust port 125 through which entrained particles are removed and delivered to a remotely located bulk canister 126, for example, where the removed particles 44*c* are collected. The exhaust air indicated at arrows 127 flows through filter 128 to remove any entrained contaminants not collected in bulk canister 126.

Both sides of a flat surface such as web or plate 12*d*, FIG. 15, can be cleaned by positioning surface cleaner and collector system 10*d* on the upper surface of web 12*d* and surface cleaner and collector system 10*d*' on the lower surface.

As shown in FIG. 16 surface cleaner and collector system 10*d* and, optionally, surface cleaner and collector system 10*d*' may be contained within an enclosure 130. Air vents 132 and 134, for example, on the top and bottom surfaces of enclosure 130, respectively, may be included to allow the air flow generated by the air sources to escape from the enclosure after filtration. Also included are side walls 120*b*, 122*d* and 120*d*' and 122*d*' (not shown) to support the air sources, and/or provide a manifold function, and/or provide seals.

FIGS. 17–20 illustrate various ways of obtaining better efficiency of the air supply. The pressure and flow rate numbers used are only exemplary. Those skilled in the art could obtain more realistic numbers based on actual energy available with the compressed air and energy losses that would take place in a system of this type.

Air supply 130, FIG. 17, supplies a 100 psi air flow at 60 scfm (standard cubic feet per minute) to regulator 132 which provides a regulated air flow of 5 psi at 60 scfm to air knife 134 over line 136. In these FIGS., 17–20, the air supply is shown schematically to be supplied over a line, however, this air supply would actually be provided over a line to a manifold, as described above, which would in turn supply the air sources with the pressurized air. In the small gap between air source 134 and idler roller 138 is entrained approximately 50 scfm of air from the atmosphere which in combination with the supplied air flow impinge upon the surface of the web supported by idler roller 138 and entrain contaminants which with the airflow travel into filter 140. As can be seen at arrow 142, 110 scfm of air is exhausted to the atmosphere. With this configuration, a positive pressure of approximately 0.1 inch WG (water gauge) in positive pressure chamber 144 is achieved, a result of back-pressure through filter 140.

A slightly different configuration which recirculates a portion of the air flow from the filter is shown in FIG. 18. Here, air supply 130*a* also supplies 100 psi at 60 scfm to regulator 132*a* which in turn supplies a regulated air flow to air source 134*a* over line 136*a*. In this configuration 60 scfm is supplied by air source 134*a*, 20 scfm of air flow is entrained from the atmosphere and 70 scfm is recirculated from the air flow out of filter 140*a*. The airflow output of filter 140*a* is 150 scfm, but because output regulator 144*a* is utilized only 80 scfm is exhausted to the atmosphere while the remaining 70 scfm is recirculated to be used to scrub the surface of the web on idler roller 138*a*. With this configuration an increase in positive pressure from 0.1 inch WG to 10.1 inches WG is achieved in positive pressure chamber 144*a*, 0.1 inch WG as a result of back pressure through filter 140*a*, and 10 inches WG as a result of output regulator 144*a*.

A configuration similar to that of FIG. 18 is depicted in FIG. 19; however, instead of utilizing a regulator, an air amplifier 132*b* is utilized. The air amplifier entrains 50 scfm of air from the atmosphere and only requires an air supply of 100 psi at 10 scfm as an input in order to supply over line 136*b* 5 psi at 60 scfm. This air amplifier configuration could be utilized in the system of FIG. 17. In the configuration shown in FIG. 20 air amplifier 132*c* is utilized and as in FIG. 19 only requires an air supply from 130*c* of 100 psi at 8 scfm to supply the same regulated output of 5 psi at 60 scfm. However, instead of entraining 50 scfm of air from the atmosphere, 52 scfm is recirculated from regulator 144*c*. Regulator 144*c* provides a regulated output of 28 scfm to the atmosphere and recirculates 70 scfm back to the input of the positive pressure chamber 144*c* to be combined with the 20 scfm which is entrained from the atmosphere and the 60 scfm which is supplied from air source 134*c*.

Although specific features of this invention are shown in some drawings and not others, this is for convenience only as each feature may be combined with any or all of the other features in accordance with the invention. Other embodiments will occur to those skilled in the art and are within the following claims:

What is claimed is:

1. A surface cleaner and collector system comprising:

a chamber having an opening for receiving a surface to be cleaned;

a pressurized air delivery system proximate said surface for establishing an air flow for loosening and entraining contaminants on said surface;

a collector for trapping said entrained contaminants and passing the air flow, the entrained contaminants directed to said collector preventing their escape from said system;

a sealing system for sealing said collector with respect to said chamber; and a delivery system for transporting the surface through the opening in said chamber.

2. The surface cleaner and collector system of claim 1 in which said surface delivery system includes an idler roller, at least a portion of which is positioned within the opening of said chamber, for supporting the surface and introducing it to said chamber.

3. The surface cleaner and collector system of claim 1 further including a static eliminator system for reducing the static electricity which binds the contaminants to the surface.

4. The surface cleaner and collector system of claim 3 in which said surface to be cleaned is one side of a thin material having two sides, a side to be cleaned and a side not to be cleaned, and said static eliminator system including at least two static eliminator bars proximate each of said sides, said thin material positioned therebetween.

5. The surface cleaner and collector system of claim 1 in which said air delivery system includes at least one air delivery device positioned proximate the surface.

6. The surface cleaner and collector system of claim 5 in which said air delivery device is positioned 0.002 to 0.500 inches from the surface.

7. The surface cleaner and collector system of claim 5 in which said air delivery device has a length substantially equal to the width of the surface to be cleaned.

8. The surface cleaner and collector system of claim 5 in which said at least one air delivery device includes a Coanda air knife.

9. The surface cleaner and collector system of claim 1 in which said air delivery system includes two spaced air delivery devices positioned proximate the surface.

10. The surface cleaner and collector system of claim 9 which said air delivery devices are each positioned 0.002 to 0.500 inches from the surface.

11. The surface cleaner and collector system of claim 9 in which said air delivery devices include Coanda air knives.

12. The surface cleaner and collector system of claim 9 further including a manifold interconnected with one end of said two air delivery devices for supplying air thereto.

13. The surface cleaner and collector system of claim 9 further including two manifolds, one manifold being interconnected with one end of each said air delivery device and the second manifold being interconnected with a second end of each said air delivery device.

14. The surface cleaner and collector system of claim 9 in which said two air delivery devices have lengths substantially equal to the width of the surface to be cleaned.

15. The surface cleaner and collector system of claim 9 further including means for adjusting the spacing between said air delivery devices and said surface.

16. The surface cleaner and collector system of claim 15 further including a surface delivery system for transporting the surface through the opening in said chamber in which said means for adjusting includes means for rotatably positioning said air delivery devices proximate the surface, wherein said means for positioning is hinged to said surface delivery system at one end and movable at its other end such that the spacing between each said air delivery device and said surface remains substantially equal throughout adjustment.

17. The surface cleaner and collector system of claim 1 in which said sealing system includes end seals for sealing said collector and said chamber with respect to said surface delivery system.

18. The surface cleaner and collector system of claim 17 in which said end seals include a gap formed by locating the ends of said surface delivery system no greater than approximately 0.200 inches from the opening of said chamber thereby limiting the escape of contaminants.

19. The surface cleaner and collector system of claim 17 in which said edge seals include at least two air delivery devices in close proximity to both ends of said surface delivery system for sealing the edges of said chamber proximate the edges of the surface.

20. The surface cleaner and collector system of claim 1 in which said collector includes a filter for trapping the entrained contaminants and passing the air flow.

21. The surface cleaner and collector system of claim 20 in which said filter is located proximate the surface and in a confronting relationship with respect to the surface so that the pattern of contaminants on the surface is depicted on the filter surface.

22. The surface cleaner and collector system of claim 20 further including a filter carrier system for removably positioning said filter proximate said chamber.

23. The surface cleaner and collector system of claim 22 in which said filter carrier system includes a removable filter carrier assembly for supporting said filter and a filter carrier assembly receiving means for receiving said filter carrier assembly.

24. The surface cleaner and collector system of claim 23 in which said filter carrier assembly includes a plurality of pressure clips which engage a like plurality of pressure clips on said filter carrier receiving means for securing said filter carrier assembly in place.

25. The surface cleaner and collector system of claim 1 further including means for recirculating the passed air flow from said collector and for introducing a recirculated air flow into the air flow established by said air delivery system.

26. The surface cleaner and collector system of claim 25 in which said means for recirculating includes means for filtering the recirculated air flow.

27. The surface cleaner and collector system of claim 25 in which said means for recirculating includes collector means for collecting heavier contaminants entrained in the passed air flow.

28. The surface cleaner and collector system of claim 25 in which said means for recirculating includes output regulator means for recirculating a portion of the passed air flow to increase said air flow and exhausting the remaining air flow to the atmosphere.

29. A surface cleaner and collector system comprising:

a chamber having an opening for receiving a surface to be cleaned;

a pressurized air delivery system proximate said surface for establishing an air flow pattern for loosening and entraining contaminants on said surface;

means for sealing said chamber against the escape of said entrained contaminants from said chamber, said means for sealing said chamber including end seals for sealing said collector and said chamber with respect to said surface delivery system;

a collector for trapping said entrained contaminants and passing said air flow; and a surface delivery system for transporting the surface through the opening in said chamber.

30. The surface cleaner and collector system of claim 29 in which said means for sealing includes a pressurized air source outlet which creates a tangential air flow over said surface for creating an air flow which seals said collector against the escape of said contaminants.

31. The surface cleaner and collector system of claim 29 in which said surface to be cleaned is one side of a thin material having two sides, a side to be cleaned and a side not to be cleaned, and a static eliminator system including at least two static eliminator bars proximate each of said sides, said thin material positioned therebetween.

32. A surface cleaner and collector system comprising:

a chamber having an opening for receiving a surface to be cleaned;

a pressurized air delivery system proximate said surface for establishing an air flow for loosening and entraining contaminants on said surface;

a collector for trapping said entrained contaminants and passing the air flow, the entrained contaminants directed to said collector preventing their escape from said system;

a sealing system for sealing said collector with respect to said chamber; and a static eliminator system for reducing the static electricity which binds the contaminants to the surface.

33. A surface cleaner and collector system comprising:

a chamber having an opening for receiving a surface to be cleaned;

a pressurized air delivery system proximate said surface for establishing an air flow for loosening and entraining contaminants on said surface, said air delivery system including two spaced air delivery devices positioned proximate the surface;

a collector for trapping said entrained contaminants and passing the air flow, the entrained contaminants directed to said collector preventing their escape from said system; and a sealing system for sealing said collector with respect to said chamber.

34. A surface cleaner and collector system comprising:

a chamber having an opening for receiving a surface to be cleaned;

a pressurized air delivery system proximate said surface for establishing an air flow for loosening and entraining contaminants on said surface;

a collector for trapping said entrained contaminants and passing the air flow, the entrained contaminants directed to said collector preventing their escape from said system;

a sealing system for sealing said collector with respect to said chamber; and means for recirculating the passed air flow from said collector and for introducing a recirculated air flow into the air flow established by said air delivery system.

* * * * *

UNITED STATES PATENT AND TRADEMARK OFFICE

CERTIFICATE OF CORRECTION

PATENT NO. : 5,836,044

DATED : November 17, 1998

INVENTOR(S) : Chandler G. Sinnett and Marshall Edward Hall

It is certified that error appears in the above-indentified patent and that said Letters Patent is hereby corrected as shown below:

TITLE PAGE:

Under Inventors, please replace "Mass." with --Me.--

Under Assignee, please replace "Mass." with --Me.--

Signed and Sealed this

Sixteenth Day of March, 1999

*Attest:*

*Attesting Officer*

Q. TODD DICKINSON

*Acting Commissioner of Patents and Trademarks*